United States Patent [19]

Goldfarb et al.

[11] 4,071,249

[45] Jan. 31, 1978

[54] DOLL HEAD HAVING TWO RANDOMLY SELECTED MOVEMENTS

[76] Inventors: Adolph E. Goldfarb, 4614 Monarca Drive, Tarzana, Calif. 91356; Erwin Benkoe, 17965 Medley Drive, Encino, Calif. 91316

[21] Appl. No.: 765,928

[22] Filed: Feb. 7, 1977

[51] Int. Cl.[2] ..... A63F 9/18

[52] U.S. Cl. ..... 273/161; 46/119

[58] Field of Search ..... 273/161; 46/118, 119, 46/120

[56] References Cited

U.S. PATENT DOCUMENTS

| | | | |
|---|---|---|---|
| 1,576,789 | 3/1926 | Robertson | 273/161 UX |
| 1,661,329 | 3/1928 | Gale | 273/161 |
| 2,368,088 | 1/1945 | Brewer | 273/161 |
| 3,456,950 | 7/1969 | Goldfarb | 273/161 |

*Primary Examiner*—Anton O. Oechsle

*Attorney, Agent, or Firm*—Robert M. Ashen; Robert J. Schaap

[57] ABSTRACT

A movable doll's head having two randomly selected movements, one a nodding movement signifying a "yes" answer, and the other a turning or "shaking" movement signifying a "no" answer. The doll's head is mounted on a support plate which is pivotally mounted for movement about a pair of axes. An actuating element, such as a playing card, may be introduced into the device so as to engage a portion of the support plate at a point offset from both axes of movement, thereby tending to cause movement about both the axes. However, a latch is operatively engageable with the support plate, to thereby cause movement to occur about only one of the axes. A camming wheel is randomly rotated by the movement of the card into and out of the device, with the resultant position of the camming wheel determining the latched or unlatched position of the latch. This in turn produces movement of the head on a random basis.

11 Claims, 7 Drawing Figures

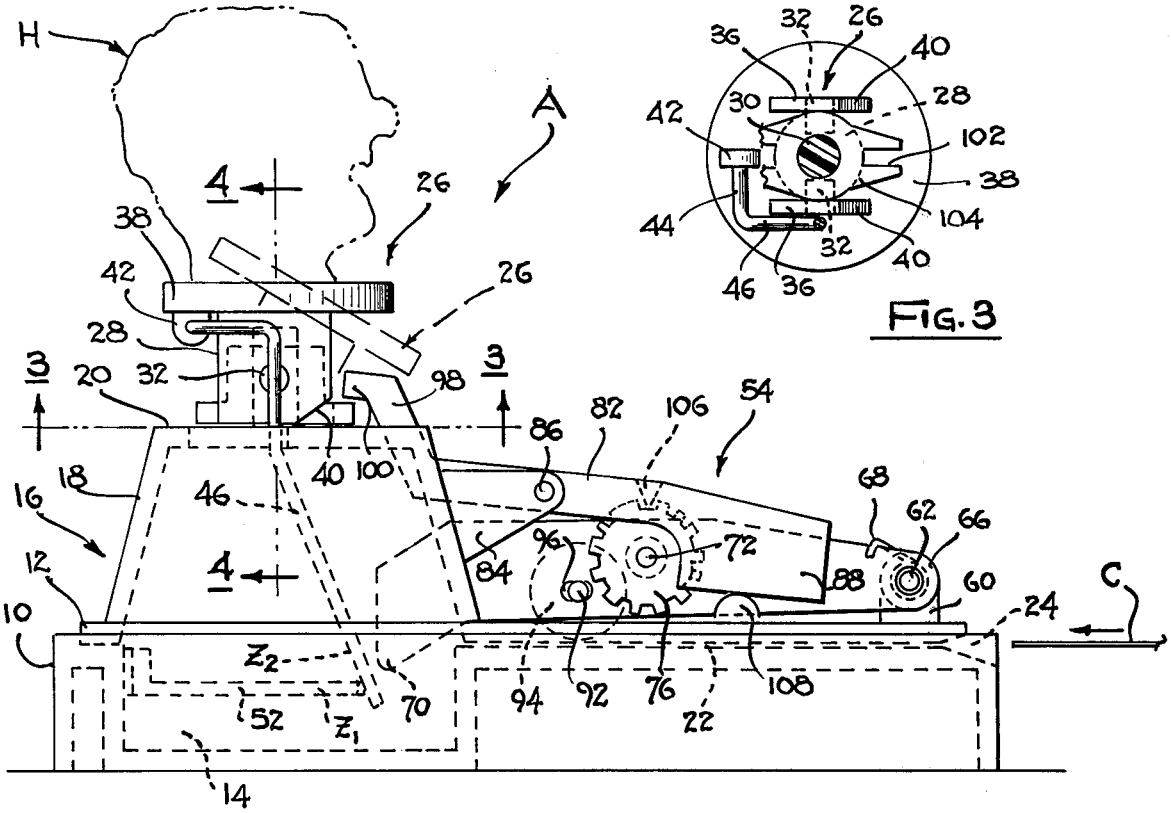
FIG. 1
FIG. 3
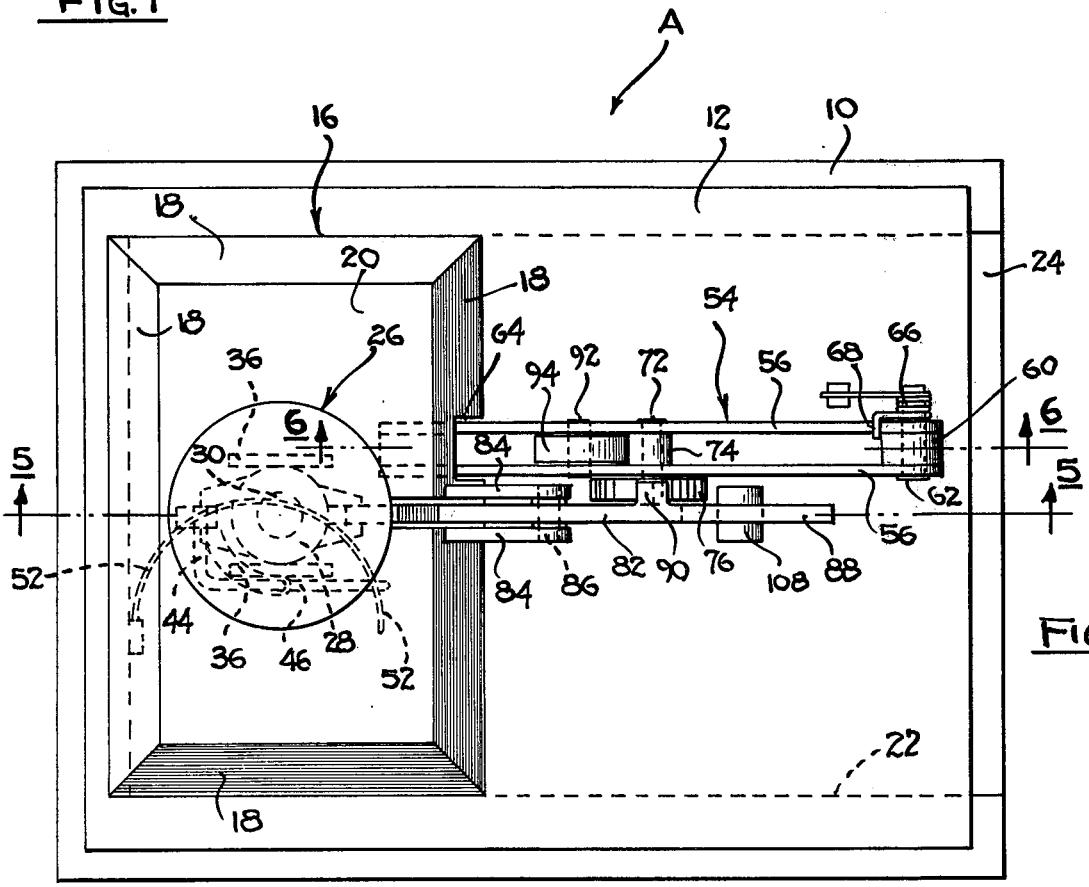
FIG. 2

DOLL HEAD HAVING TWO RANDOMLY SELECTED MOVEMENTS

BACKGROUND OF THE INVENTION

This invention relates in general to certain new and useful improvements in doll heads providing nodding movement and a turning movement to signify respective "yes" and "no" answers on a random basis, and, more particularly, to movable doll heads of the type stated which provide nodding and turning movements on a random basis through an independently actuable camming mechanism.

Doll heads having two randomly selected movements are known in the art, as for example, one such doll head is taught in U.S. Pat. No. 3,456,950. These doll heads are useful play devices, primarily for children, since they can provide yes and no responsive movements on a random basis, and can be used either alone, as a type of fortune-telling device, or in conjunction with the playing of different types of games in which yes and no decisions are made.

It can be appreciated that the value of this type of doll head to children would be depreciated if the selection was made on any other than a random basis, since one response would be provided more often than the other of the responses. In addition to the above, it can be observed that this form of device could also find use as an "adult's toy", as for example, a so-called "executive" decision maker.

One of the primary problems with doll heads providing randomly selected responses of this type is that in order to obtain true random selection of a response, the device is usually complicated in its structure and, hence, fairly costly to manufacture. Moreover, and also due to the necessity of obtaining true randomness of a response, the device had to be constructed in such manner as to withstand use for a considerable period of time and still maintain the possibility of providing random response. The devices of the prior art were deficient in these respects since they were unduly complicated and also, after a period of time, were not capable of providing true random responses.

The present invention obviates these and other problems in the provision of a device having a movable doll's head which is capable of providing a nodding movement signifying a "yes" answer and a turning, or so-called "shaking" movement, which signifies a "no" answer. The device is operable by means of an actuating element, such as a card, which is inserted in the device for initiating the response of the doll's head. The random movement is created by a camming wheel which operates in conjunction with a latch, the latter controlling either of the movements. The camming wheel is freely rotated such that the high cam surfaces and low cam surfaces will determine the position of the latch and, hence, the movement of the doll head.

OBJECTS OF THE INVENTION

It is, therefore, a primary object of the present invention to provide a doll's head having two degrees of randomly selected movement, one of which signifies a "yes" answer and the other of which signifies a "no" answer by means of a unique camming means which independently and randomly controls the movement of the doll's head.

It is another object of the present invention to provide a device of the type stated which is capable of being manufactured at a relatively low unit cost and which is, nevertheless, highly efficient in its operation.

It is a further object of the present invention to provide a device of type stated which is capable of maintaining its ability to function randomly over prolonged periods of use.

With the above and other objects in view, our invention resides in the novel features of form, construction, arrangement and combination of parts presently described and pointed out in the claims.

BRIEF SUMMARY OF THE DISCLOSURE

A random decision-making device capable of providing both a positive and a negative response on a random basis. The device comprises a support member which is capable of a first rotational movement about a generally vertical first axis which signifies a negative response. The support plate is also capable of a second rotational movement about a generally transverse axis which signifies a positive response. A doll's head is carried by and is movable with the support member to signify either the positive or the negative response.

The device is operable with an actuating element, such as a plastic card, which is used by the players of the device. This actuating element engages an arm extending downwardly from the support member and bears against the arm at a point offset from the first axis and at a point also offset from the second axis. In this way, the card tends to bias the support member in both the first and second movements.

A latch is intermittently engageable with the support member and when the latch is engaged with the support member the second nodding movement occurs. However, when the latch is not engaged with the support member, the first side-to-side movement occurs which, as indicated, signifies a negative response.

A rotatable camming wheel controls the position of the latch by means of high camming surfaces and low camming surfaces on the cam wheel. When the card is inserted inwardly into the device, a roller is displaced by the card out of engagement with the camming wheel. The position in which the camming wheel was left at the end of the previous determination will thereby provide the determination of whether a negative or a positive response will be rendered. When the card is pulled outwardly, the roller is rotated and biased into operative engagement with the camming wheel, thereby rotating the camming wheel on a random basis to a new position. The position in which the camming wheel comes to rest will determine whether a high cam surface or low cam surface on the camming wheel moves the latch into or out of engagement with the support member when the card is reinserted. Thus, the random selection of the next answer is preset in the device each time the user inserts the actuating card.

BRIEF DESCRIPTION OF THE DRAWINGS

Figure 4:
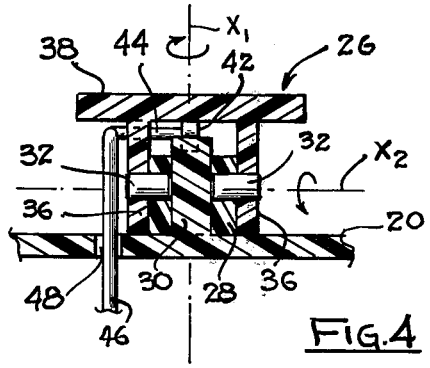
Figure 5:
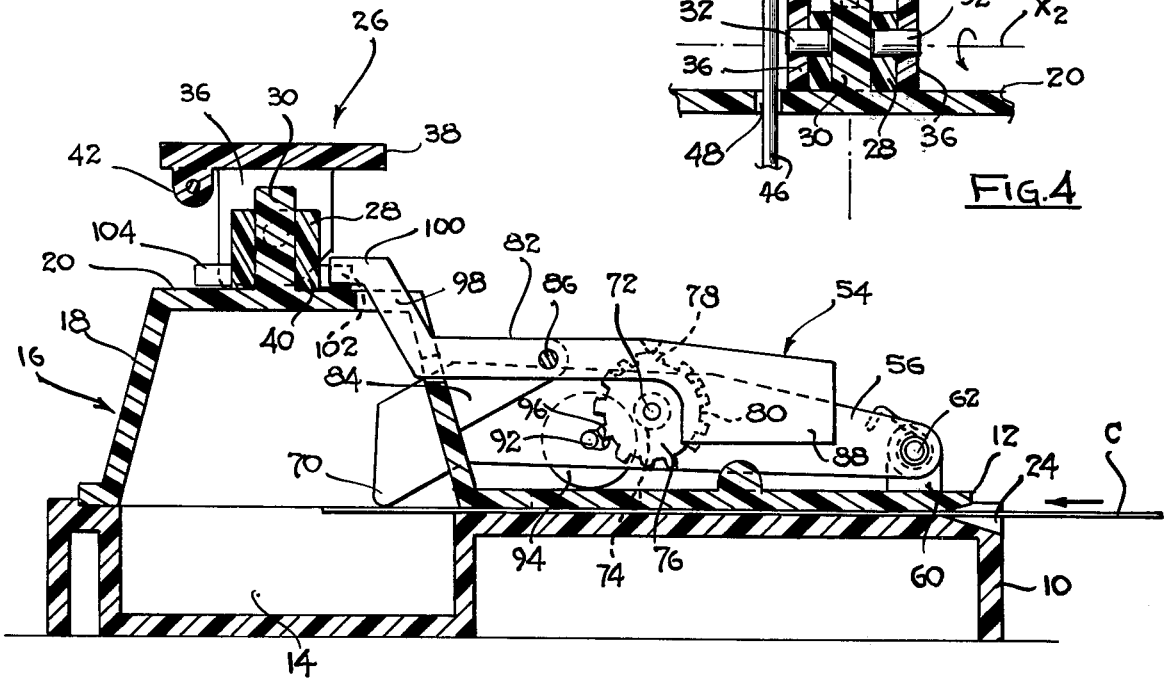
Figure 6:
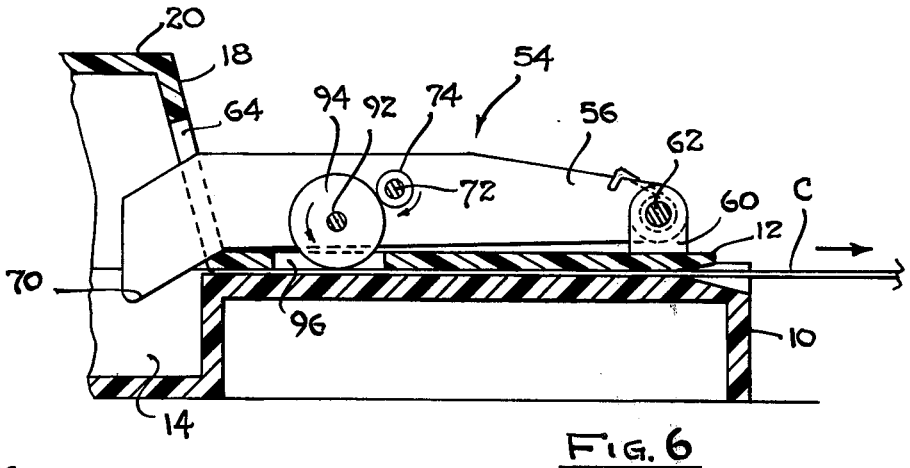
Figure 7:
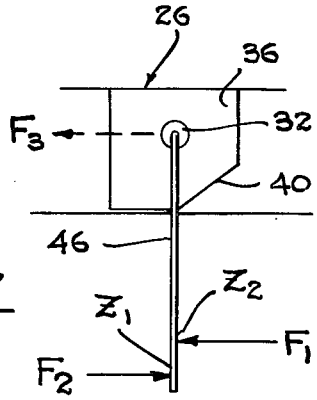

Having thus described the invention in general terms, reference will now be made to the accompanying drawings in which:

FIG. 1 is a side elevational view of the device constructed in accordance with and embodying the present invention, with the doll's head and other components shown in dotted lines for purposes of clarification;

FIG. 2 is a top plan view of the device of FIG. 1;

FIG. 3 is a horizontal sectional view, taken from below along line 3—3 of FIG. 1, and showing the head support structure forming part of the device;

FIG. 4 is a fragmentary vertical sectional view, taken along line 4—4 of FIG. 1;

FIG. 5 is a vertical sectional view taken along line 5—5 of FIG. 2, and showing a position of several of the components of the device upon entry of an actuating card;

FIG. 6 is a fragmentary vertical sectional view, somewhat similar to FIG. 5 and taken along line 6–5 of FIG. 2, and showing the position of the components in the device as the actuating card is removed from the device; and FIG. 7 is a schematic view showing a vector diagram of the forces operating upon an arm connected to the support member for creating the biasing movement of the support member in the device of the present invention.

DETAILED DESCRIPTION OF THE PREFERRED EMBODIMENT

Referring now in more detail and by reference characters to the drawings, A designates a device capable of providing two degrees of randomly selected movement, one of which signifies a positive response and the other of which signifies a negative response.

The device A comprises a base frame 10 having a top plate 12 rigidly secured thereto. The base frame 10 is also constructed with an integrally formed recessed portion 14 near the rearward end thereof, in the manner as illustrated in FIGS. 1 and 2 of the drawings.

Secured to the top plate 12 and extending over the recessed portion 14 is an upstanding housing 16 comprised of four rectangularly located upwardly and inwardly inclined walls 18, and which are connected at their upper margins by means of a top wall 20. A card-receiving slot 22 is formed between the top plate 12 and the upper surface of the frame 10, and is provided with a card inlet aperture 24 at the forward end of the frame 10. Moreover, it can be observed that this card-receiving slot 22 extends into the recessed portion 14 and under the housing 16.

The card-receiving slot 22 is designed to receive an actuating member in the form of a plastic card C, which is used to generate a response from the device. Any other form of actuating member may also be employed in this regard, in the manner as hereinafter described in more detail.

Mounted on the top wall 20 of the housing 16 is a saddle structure 26 comprised of an upstanding support post 28 which is provided for rotatable movement with respect to the top wall 20 of the housing 10. The support post 28 is rotatably mounted on a fixed rod 30 which is mounted on the top wall 20 of the housing 16. In this way, the post 28 is capable of providing a rotative movement of the saddle structure 26 about a vertical axis, designated as X in FIG. 4 of the drawings.

Extending outwardly from the post 28 are a pair of diametrally opposed pivot pins 32, for fixed mounting in a pair of downwardly extending flange plates 36 on diametrally opposite sides of a relatively flat support plate 38, the latter of which also forms part of the saddle structure 26. In accordance with this construction, it can be observed that the post 28 can rotate about the pivot pin 30 to cause a rotative movement of the support plate 38 about the vertical axis X, extending through the pivot pin 30. In like manner, the support plate 38 can pivot forwardly about a horizontal axis designated as $X_2$ through the pivot pins 32. In this way, 2° of movement are provided. For this purpose, the flange plates 36 are provided with bevelled ends 40 in order to permit the forward pivotal movement of the support plate 38. It can be observed that the axis $X_2$ is perpendicular to the axis X and permits pivotal movement in a plane defined by the axis $X_2$.

A suitable doll's head, designated as H and shown in phantom lines in FIG. 1, may be mounted on the top surface of the support plate 38. The doll's head H is generally conventional in its construction and may be provided with a flat bottom wall for adhesive securement or for other means of conventional attachment to the support plate 38. As indicated above, the doll's head is only decorative to provide the indication of either a positive or negative response.

Mounted on the underside of the support plate 38 in the rearward portion thereof is a depending lug 42 (FIGS. 1 and 3), and mounted therein is the terminal end 44 of an actuating arm 46 which extends downwardly through a slot 48 (FIGS. 2 and 4) formed in the top wall 20 of the housing 16. Moreover, the arm 46 is bent forwardly and then downwardly as illustrated in FIGS. 1 and 2 of the drawings. The lower end of the actuating arm 46 is bent forwardly, in the manner as illustrated in FIG. 1, so as to be engaged by the actuating card C as it is inserted into the slot 22. In addition, a spring 52 is mounted on the inner surface of one of the walls 18 of the housing 16 or otherwise the frame 10 and is located to engage the lower end of the actuating arm 46.

By further reference to FIG. 1, it can be observed that the spring 52 engages the actuating arm 46 at a point designated as $Z_1$ and the actuating card C engages the actuating arm 46 at a point $Z_2$ which is spaced upwardly from the point $Z_1$. In addition, it can also be observed that the spring 52 opposes the action of the card C as it is pushed into the device A through the slot 22. Finally, and by reference to FIGS. 1, 2 and 7, it can be observed that the card C and the spring 52 engage the actuating arm 46 at a point which is displaced downwardly from the axis of rotation of the pivot pins 32, that is the axis $X_2$, and also is displaced outwardly from the axis of rotation of the post 28, that is the axis $X_1$.

By further reference to FIG. 7, it can be observed that the card C exerts a force $F_1$ and the spring exerts a force $F_2$ opposite to that of the force $F_1$. Inasmuch as these forces are applied at a point donwardly from the horizontal axis of the pivot pins 32, i.e., the axis $X_1$, a resulting horizontal force $F_3$ occurs at the pivot pins 32. In addition, it can be observed that if this force $F_3$ is offset from the axis of rotation of the post 28, and if the force $F_3$ is unopposed, a rotation of the post 28 and the entire saddle structure 26 will result about the vertical axis $X_1$ passing through the pivot pin 30. In like manner, it can also be observed that if the force $F_3$ were opposed by means of a latch mechanism, as described hereinafter, then the resultant of the forces of $F_1$ and $F_2$ is a torque which causes pivoting of the saddle structure 26 about the horizontal axis $X_2$ extending through the pivot pins 32.

The bevelled ends 40 on each of the depending flanges 36 serve as "stops" which set the maximum degree of inclination of the saddle structure 26 about the horizontal axis $X_2$ defined by the pivot pins 32, inasmuch as these bevelled ends 40 will contact the top wall 20 of the housing 16 at the maximum degree of forward movement.

Mounted on the top plate 12 is a latching mechanism 54 which comprises a pair of transversely spaced sensor arms 56. The arms 56 are pivotally mounted on an upstanding block 60, which is, in turn, affixed to the top plate 12, and the pivotal movement of these arms 56 occurs through a pivot pin 62. The rearward end portions of these arms 56 extend through an aperture 64 formed within in the forwardly presented side wall 18 of the housing 16. Moreover, the arms 56 are biased downwardly by means of a spring mechanism 66 having a spring arm 68 which bears against the upper margin of one of the arms 56, in the manner as illustrated in FIGS. 1 and 2.

By further reference to FIGS. 1 and 5–6, it can also be observed that the arms 56 have terminal end portions 70 which extend downwardly below the path of movement of the card C, and into the recessed portion 14. Thus, when the card C is shifted into the slot 22, the card C will engage the lower ends 70 and bias the arms 56 upwardly against the action of the spring mechanism 66. As this occurs, the arms will be shifted upwardly to the position as illustrated in FIG. 5 of the drawings.

A cam pin 72 is mounted within the pair of transversely spaced apart sensor arms 56 and extends outwardly therefrom. Located between the pair of sensor arms 56 is a sleeve 74, in the manner as illustrated in FIGS. 1, 2, 5 and 6 of the drawings. Mounted on the outer end of the cam pin 72 is a camming wheel 76, which has somewhat the appearance of a gear-wheel. However, the camming wheel 76 is provided with both high camming surfaces 78 and recesses, or so-called "low" camming surfaces 80, as more specifically illustrated in FIG. 5. In addition, it can be observed that the camming wheel 76 is so constructed that the high surfaces 78 and the low surfaces 80 are irregular in shape. In other words, the high camming surfaces may be either wide or narrow in the circumferential direction and the same holds true for the camming recesses 80.

By further reference to FIGS. 1, 2 and 5 of the drawings, it can be observed that a latch 82 is pivotally mounted on a pair of forwarding extending arms 84 which extend from the housing 16, by means of a pin 86. Moreover, the latch 82 is provided with a weight forward end 88, which serves as a form of a counterweight, so as to bias the forwardly presented end thereof, that is the end proximate to the inlet aperture 24, downwardly. The camming wheel 76 cooperates with the latch 82 through an extension 90 on the latch 82, in the manner as illustrated in FIG. 2 of the drawings. Also mounted in the sensor arms 56 is a roller pin 92 which carries a roller 94, the latter of which is engageable with the sleeve 74, in the manner as illustrated in FIGS. 1 and 2 of the drawings. The roller pin 92, however, is longitudinally shiftable within a slot 96 formed within the sensor arms 56, and which is more fully apparent in FIG. 1 of the drawings.

Thus, as a card C is inserted in the slot 22, it will bear against the roller 94 and tend to bias the roller pin 92 within the elongated slot, outwardly from engagement with the sleeve 74. As this occurs, the camming wheel 76 will not be rotated, but the card C will still be urged forwardly within the slot 22, in the manner as illustrated in FIG. 5 of the drawings. However, when the card C is pulled outwardly in the manner as illustrated in FIG. 6, the roller 94 will extend through a slot 96 formed in the top plate 12 when the card is disengaged from the extended ends 70, and will be rotated in the direction of the arrow during movement of the card C. Moreover, the roller 94 will be urged forwardly in the direction of the movement of the card in FIG. 6, and will also engage the sleeve 74 to thereby cause rotation of the sleeve 74 and also the camming wheel 76.

Referring now to FIGS. 1 and 5 of the drawings, it can be observed that the latch 82 is provided with an upwardly struck portion 98 having a rearwardly struck tab 100 which extends into a notch 102 formed on a flange plate 104 surrounding the post 28 and being movable therewith. Again, by reference to FIG. 5, it can be observed that when the latch 82 is in the lowermost position, it will be engaged in the notch 102 and when shifted to the uppermost position, as illustrated in FIG. 1, it will not be engaged with the notch 102.

The latch 82 is also provided with a detent or so-called "cam-lug" 106 which is capable of engaging the high and low surfaces on the camming wheel 76, and thus responds to the position of the camming wheel 76. In accordance with this construction, it can be observed that if the detent 106 engages a low surface 80 on the camming wheel 76, then the latch 82 will be shifted to the upward position, as illustrated in the solid lines in FIG. 1 of the drawings. In like manner, if the detent 106 engages a high surface 78 on the camming wheel 76, then the tip 100 of the latch 82 will be shifted to the lowermost position, as illustrated in FIG. 5 of the drawings, where the terminal end thereof is located within the notch 102. It can also be observed that the latch 82 is also limited in its upward movement, that is, out of the notch 102, by means of a stop 108 located on the top plate 12, reference being made to FIGS. 1 and 5 of the drawings.

The various components forming part of the device A with perhaps the exception of the spring mechanism (hereinafter described) in the device A can all be constructed of a number of well-known plastic materials including for example, polyethylene, polystyrene, polybutadiene, a number of known vinyladiene copolymers and the like. These components may be formed in any of a number of known plastic forming techniques including blow molding, injection molding, thermo-forming and the like. However, it can also be observed that many of the components forming part of the device A could be formed of other materials including light weight metals, such as aluminum or the like. Moreover, these various components can be formed of reinforced plastic materials as for example, resin matrix reinforced plastics including, e.g., thermosetting and thermoplastic resins along with various fiberous materials such as glass, boron, carbon or the like. The particular materials used in the construction of these components will be predicated upon necessary strength requirements and desired durability as well as manufacturing costs.

In accordance with the above-outlined construction, it can be observed that as the user of the device inserts a card C into the slot 22, it will bias the roller 94 out of engagement with the sleeve 74. Moreover, the card C will continue to be inserted into the slot 22 until it engages the lower end 70 of the sensor arms 56, thereby biasing the sensor arms 56 upwardly. Moreover, the card C will also engage the actuating arm 46. As this occurs, the actuating arm 46 will be biased rearwardly against the action of the compression spring 52. By means of this action, there will be a tendency to rotate the saddle 26 about the vertical axis $X_1$ and also about the horizontal axis $X_2$. The actual movement which will occur will be dependent upon the position of the latch 82.

If the latch 82 is in the upper position, as illustrated in FIG. 1 of the drawings, then the support plate 38, and hence the entire saddle mechanism 26, will be permitted to rotate about the vertical axis $X_1$ through the post 28. However, if the latch 82 is in the lower position, as illustrated in FIG. 5 of the drawings, then only the pivotal movement of the support plate 38, and hence the head H, will be permitted in the vertical plane about the axis $X_2$. It can be observed by reference to the force diagram of FIG. 7 that there will be a greater tendency for the support plate to rotate than pivot. Thus, if the latch is in the upper position, rotational movement will occur without the need for preventing the pivotal movement.

When the card C is withdrawn from the apparatus, it can be observed that the card will engage the roller 94, thereby biasing the roller pin 92 rearwardly within the slot 96. In this case, the roller 94 will engage the sleeve 74 and thereby cause rotation of the camming wheel 76. This rotation of the camming wheel 76 will continue until the card C is fully disengaged from the roller 94. Nevertheless, during the removal of the card C, the roller 94 will continue to rotate and thereby rotate the camming wheel 76. As the card C is removed from engagement with the roller 94, rotation of the roller 94 will cease and, hence, rotation of the camming wheel 76 will also cease. However, it can also be observed that as the high and low portions on the camming wheel 76 are irregular, the exact position of the camming wheel is only determined by the removal of the card C. Accordingly, if a high camming surface 78 on the camming wheel 76 is in contact with the detent 106, then the latch 82 will be biased toward the upper position. In like manner, if the detent 106 is in engagement with a low camming surface 80, then the latch 82 will be biased to its upper position. Accordingly it can also be observed that if the latch 82 is biased to its upward position, then, upon the entry of a card C on the next determination, a rotative or negative response will be obtained. In like manner, if the detent 106 is located in a high camming area 80, then the latch 82 will be engaged in the slot 102 and it will permit only pivotal movement of the saddle mechanism 26. In this way, only a positive response will be achieved on the next determination. In accordance with this construction, it can be observed that the determination of a response is predicated upon the position of the camming wheel 76 which is, in turn, dependent upon the removal of the card C in the previous determination.

Thus, there has been illustrated and described a unique and novel device which permits two degrees of movement on a randomly selected basis operable with a unique camming means, and which therefore fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention, which is limited only by the following claims.

Having thus described our invention, what we desire to claim and secure by letters patent is:

1. A random decision making device capable of providing a positive and a negative response on a random basis, said device comprising:

a. a support means capable of a first pivotal movement about a first generally transversely extending axis representative of a positive response and of a second pivotal movement about a second generally vertical axis representative of a negative response, b. a doll's head carried by and being movable with said support means to signify the positive or negative response, c. a separate actuating element used by a player of the device for operatively bearing against said support means at a point offset from said first axis and at a point offset from said second axis tending to bias said support means in both said first and second pivotal movements, but said support means tending to undergo only one of said movements in response to said bias if said support means is free to undergo either of said movements, d. a latch intermittently engageable with said support means to permit said one of said movements when not engaging said support means and to permit only the other of said movements when engaging said support means, e. rotatable camming means operatively associated with said latch and having portions thereon which bias said latch out of engagement with said support means when said camming means is rotated to certain positions and permit said latch to be operatively engaged with said support means when rotated to other positions to thereby control the selection of the first or second movements, and f. random selection means operatively associated with said camming means and being located to cause random rotation of said camming means through the action of said separate actuating element.

2. The device of claim 1 further characterized in that said random selection means comprises a rotatable member caused to rotate by movement of the separate actuating element and to thereby effect contact with and rotation of said rotatable camming means.

3. The device of claim 2 further characterized in that said actuating element causes intermittent contact between said rotatable selection member and said rotatable camming means.

4. The device of claim 1 further characterized in that said actuating element is a flat card-like element which engages said support means to bias it in both said pivotal movements.

5. The device of claim 4 further characterized in that spring means biases said support means in opposition to said card-like element.

6. A device having a doll head capable of providing a nodding action signifying a positive response and a side-to-side shaking action signifying a negative response on a random basis, said device comprising:

a. a frame, b. a doll's head, c. a support means on which said doll's head is carried, d. first pivot means supporting said support means on said frame for pivotal movement about a generally horizontal axis and in a vertical plane for nodding action to signify a positive response, e. second pivot means supporting said support means on said frame for pivotal movement about a generally vertical axis for side-to-side shaking action to signify a negative response, f. means operatively engageable with said support means to urge said support means to pivot about both of said axes, but said support means tending to pivot about only one of said axes in response to said urging if said support means is free to pivot about either axis, g. latch means movably supported on said frame and engageable with said support means for permitting movement of said support means about only the other of said pivot means when in a latched position relative to the support means and permitting movement of said support means about said one of said pivot means when in an unlatched position relative to said support means, h. camming means movably mounted on said frame and operatively engageable with said latch means for controlling the position of said latch means between said latched and unlatched positions by virtue of the positions of said camming means, and i. random selection means movably mounted on the frame and movable when engaged by a separate actuating element used by a player of the game, said random selection means being operatively engageable with said camming means at each response of the device to cause said camming means to be randomly moved to a new position where it controls the next response of the device.

7. The device of claim 6 further characterized in that said actuating element is a card-like element which engages said support means to tend to move said support means in both said pivotal movements.

8. The device of claim 7 further characterized in that spring means biases said support means in opposition to said card-like element.

9. The device of claim 8 further characterized in that said random selection means comprises roller means that is shifted into and out of engagement with said camming means by means of said card-like element.

10. The device of claim 6 further characterized in that said actuating element operatively bears against said support means at points offset from said first and second axes tending to initially bias said support means in both said pivotal movements.

11. The device of claim 6 further characterized in that said camming means comprises a rotatable disc with high portions and low portions thereon which cause unlatching and latching of said latch means.

* * * * *